United States Patent [19]

Chang

[11] Patent Number: 4,776,060

[45] Date of Patent: Oct. 11, 1988

[54] AUTOMATIC TERMINATION AND ALARM STRUCTURE FOR MOTORS USED IN VERSATILE VACUUM CLEANER

[76] Inventor: Jiing Lai Chang, 916-11 Fongs Road, Fong Yuang City, Taichong Hsien, Taiwan

[21] Appl. No.: 48,207

[22] Filed: May 11, 1987

[51] Int. Cl.[4] ..... A47L 7/00

[52] U.S. Cl. ..... 15/339; 15/353

[58] Field of Search ..... 15/339, 353

[56] References Cited

U.S. PATENT DOCUMENTS

| | | | |
|---|---|---|---|
| 3,034,273 | 5/1962 | Wallace | 15/353 X |
| 3,048,875 | 8/1962 | Bottinelli et al. | 15/353 X |
| 3,056,994 | 10/1962 | Noble | 15/353 X |
| 3,165,774 | 1/1965 | Barba | 15/353 X |
| 3,173,164 | 3/1965 | Congdon | 15/353 X |
| 3,774,260 | 11/1973 | Emus | 15/353 X |
| 4,080,104 | 3/1978 | Brown | 15/353 X |
| 4,616,378 | 10/1986 | Berfield et al. | 15/353 |

*Primary Examiner*—Chris K. Moore

*Attorney, Agent, or Firm*—Armstrong, Nikaido, Marmelstein & Kubovcik

[57] ABSTRACT

A multi-purpose vacuum cleaner for solids and liquids includes a motor mounting seat covering the vacuum cleaner tank and having a circular orifice, a filter cage mounted about the orifice on the underside of the motor mounting seat containing a spherical float, and a switch connected to the float so as to be operated when liquid in the tank reaches a predetermined level. Rising of liquid in the tank to the predetermined level lifts the float to obstruct the orifice, preventing liquid from entering the motor, and actuates the switch to disconnect power from the motor and to energize an alarm.

2 Claims, 3 Drawing Sheets

AUTOMATIC TERMINATION AND ALARM STRUCTURE FOR MOTORS USED IN VERSATILE VACUUM CLEANER

BACKGROUND OF THE INVENTION

The present invention relates to an automatic termination, or power cut off device, and alarm structure for motors used in multi-purpose vacuum cleaners, and more particularly, to a bifunctional vacuum cleaner suitable for sucking dust and other solid matter and also sucking liquid which includes a micro switch and a buzzer alarm, wherein the cutting off of power supply for the motor is chiefly achieved by a spherical float installed in the filter cage assembly below the sucking orifice of the motor. This float is connected with a string which passes through a fixed point and reverses direction to be connected to the spring leaf of a micro switch. When the tank is filled of liquid to a level that will raise said float to a certain height, said float will block the sucking orifice and pull the string attached to the spring leaf of the micro switch to break the power supply for motor. At this time, power supply for motor is stopped and a buzzer is connected to give out an alarm. At a result, bilateral control of water flow and high safety and longevity are achieved.

Heretofore, conventional multi-purpose vaccum cleaners use a single arrangement of a rising float to block the sucking orifice of the motor directly. As a result, the following defects will be found: (1) Incomplete blocking results and overflow occurs easily: the production technique for making the float and sucking orifice is not precise enough, and the sphericity is also not enough, complete blocking cannot be achieved and overflowing will result. (2) The motor has short working life and becomes short circuited easily: blocking of the orifice is incomplete, water will be sucked into the motor and penetrate into its circuit to cause a short working life and short circuit. (3) Idle run of the motor will cause burn-out easily and is a waste of energy: when the float rises up to block the sucking orifice, the motor is still rotating, it will be burned out easily and also cause an increase in power consumption.

Since there are so many deffects commonly existing in the known type of multi-purpose vacuum cleaner, a two-sectional control for water flow and automatic power cut off for the motor is designed which provides an alarm by means of a buzzer to achieve operation with a high degree of safety.

SUMMARY OF THE INVENTION

It is a primary object of the present invention to provide a dual structure for control of water flow, comprising mainly a micro switch installed on a motor cover, the spring leaf contact of said micro switch is connected with a string within a filter cage assembly, on a motor fixing seat and the string is deflected to be fixed to said float, and so when liquid is sucked, the float will rise up due to the surface tension of liquid to block the sucking orifice and pull the spring contact leaf of the micro switch to cut off the power supply for the motor to immediately achieve the function of dual control of water flow.

Another object of the present invention is to provide a structure with a bilateral cut-off function, which utilizes mainly the two-sectional conduction structure of the micro switch, with one end contact connected to the power source, one end contact connected to the motor and the other end connected to a buzzer, and so when the motor switch is pulled by said float to cut off the power supply, said buzzer will be connected and emit a "buzz" sound immediately to achieve the dual function of cut-off of power supply and providing an alarm.

A further object of the present invention is to provide a controlling device with a high degree of safety and long life, wherein since the dual control of water flow makes sure that when the tank is filled with water to a certain height, the motor will be cut off from the power supply and the buzzer will give out an alarm immediately to inform an operator to close the power supply to prevent idle running of the motor and waste of energy.

These and other objects will become apparent from the following detailed description taken in conjunction with the accompanying drawings.

DETAILED DESCRIPTION OF THE PREFERRED EMBODIMENT

Figure 1:
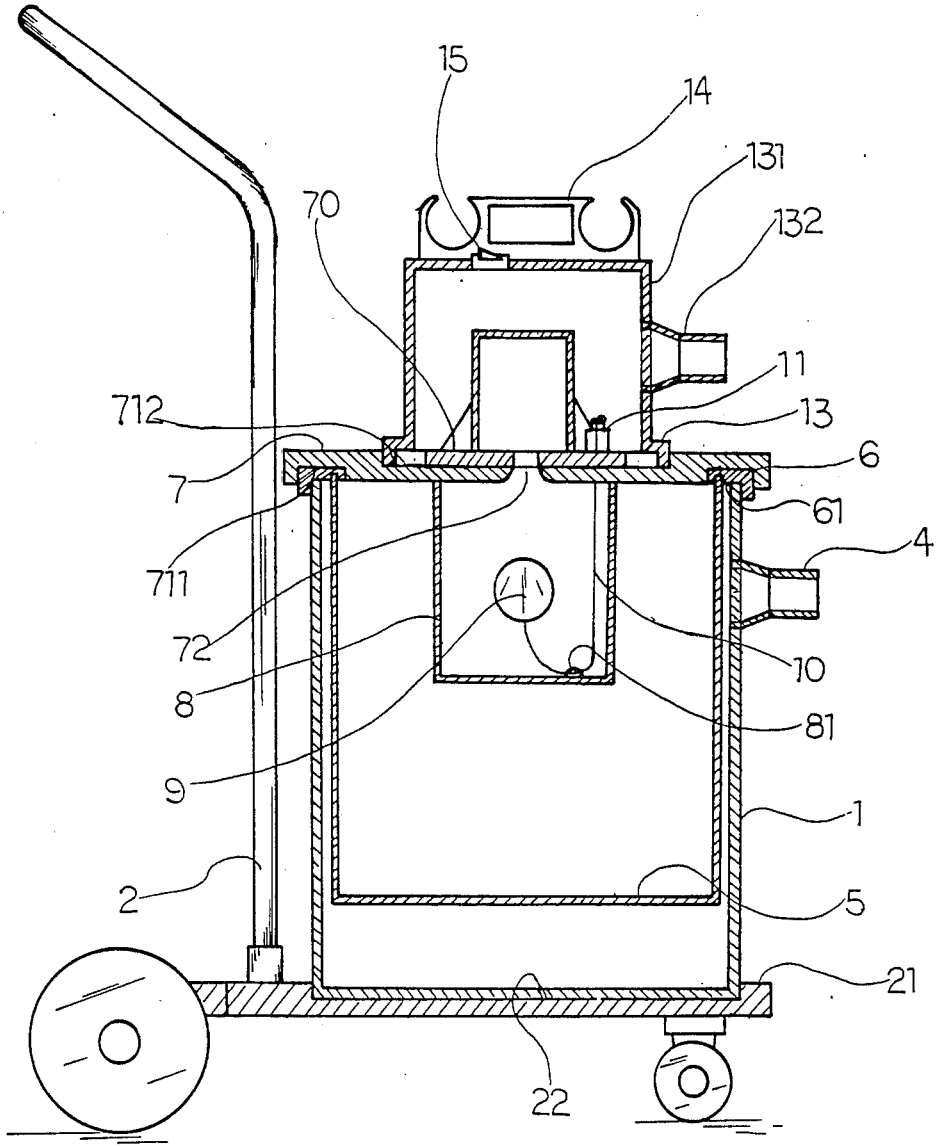
FIG. 1 is a sectional view of a multi-purpose vacuum cleaner in accordance with the present invention.
Figure 2:
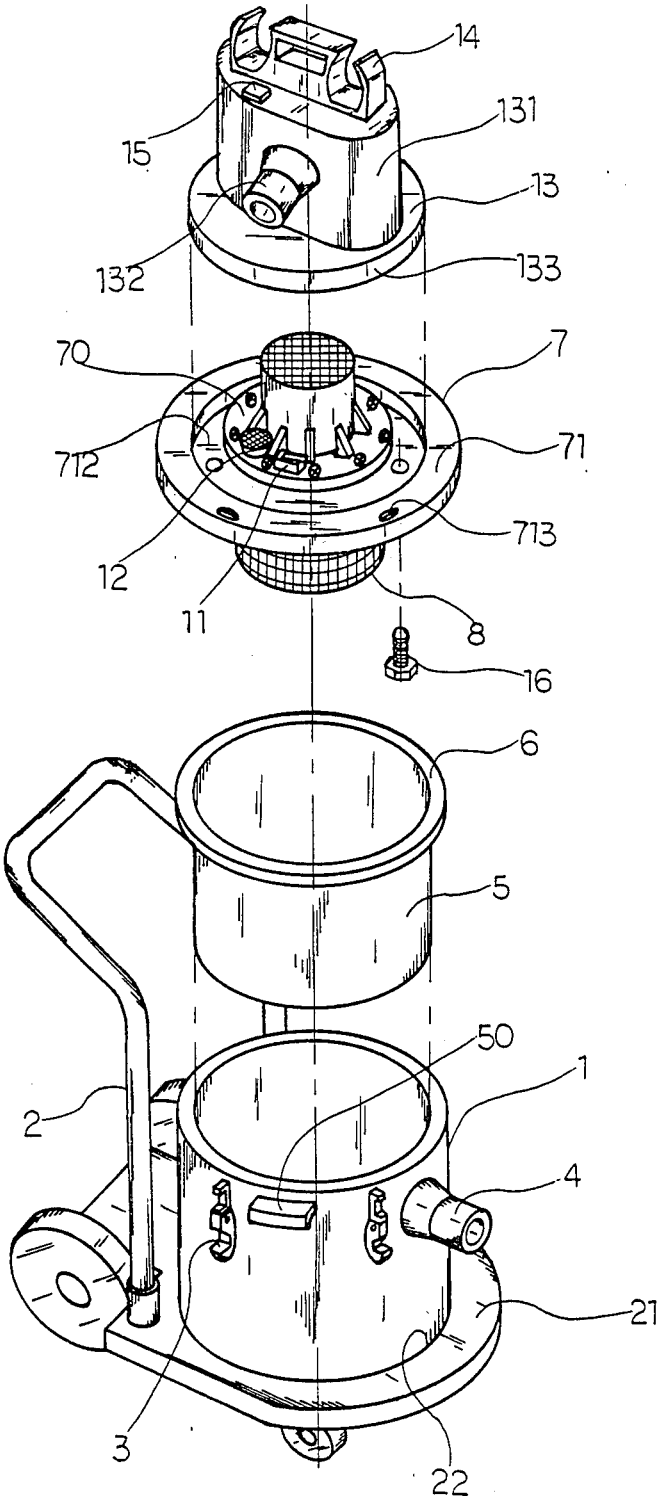
FIG. 2 is a perspective, exploded view of a multi-purpose vacuum cleaner in accordance with the present invention.

Referring to FIGS. 1 and 2, it can be seen that the present invention comprises a tank (1), having a dolly (2) at its lower portion, three clamps (3) at its upper edge, a vacuum cleaner inlet hose connector (4) in its face and handles fixed to the side of the tank.

A canvas filter bag (5) has its upper edge fixed to a rubber circular frame (6) to form an inverted U-shaped slot (61), (as shown in FIG. 1).

Figure 3:
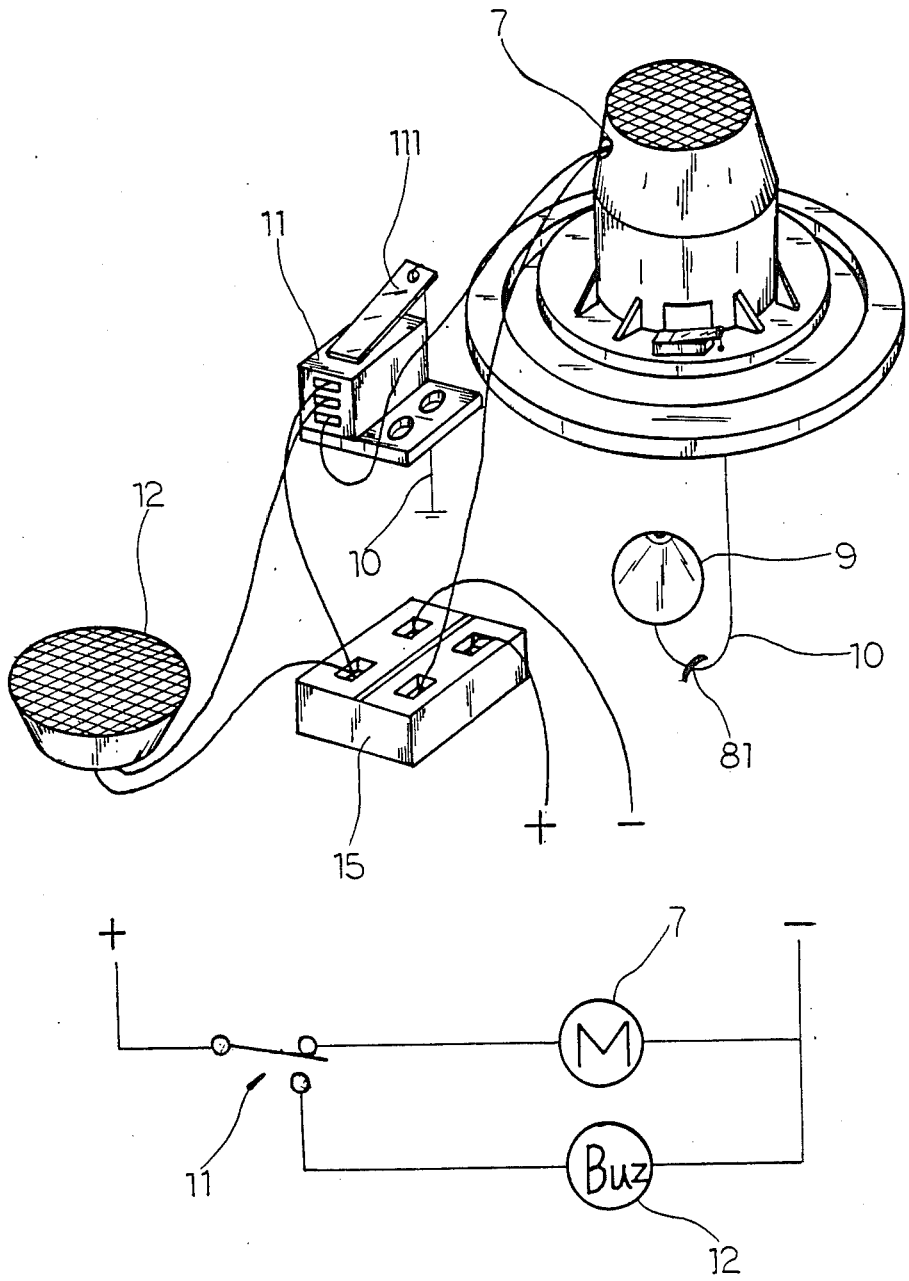
FIG. 3 is an electronic circuit diagram of an automatic cut off and alarm structure for motors used in a multi-purpose vacuum cleaner in accordance with the present invention.

A motor mounting seat (7), wherein the base at its outer diameter (71) has a circular slot (711), (as shown in FIG. 1), has its upper surface formed with an inverted U-shaped circular slot (712). The lower edge has fixed thereto a circular filter cage (8). The filter cage has a plastic float (9) inside (as shown in FIG. 1 and FIG. 3), which is connected by a string (10) to a spring contact leaf (111) of micro switch (11) on the motor mount plate (70). The string passes through a fixed point (81) of cage 8 and returns to be connected to said float (9).

A motor mount plate (70) is fixed on said motor mounting seat (7), and micro switch (11) and buzzer (12) are also fixed on said motor mount plate (70).

An upper cover (13), has its upper side formed in a long and narrow protruded shape (131), having an outlet hose connector (132) formed on a side face, a handle (14) formed by a pair of semicircular grooves and a push-button power switch (15) fixed at its upper surface, the string (10) used for fixing said float (9) inside the circular filter cage (8) at the lower surface of motor mounting seat (7) is reversed in direction at point (81) and fixed to a spring contact leaf (111) of micro switch (11) at the upper side of motor mount plate (70). The distance said float is to float up to the sucking orifice (71) at the interior of motor mounting seat (7) and the distance to be pulled to switch off the micro switch (11) and stop the rotation of the motor are determined. After the power supply connection is completed, circular seat (133) of upper cover (13) is inserted into the circular slot (712) at the upper side of the outer diameter (71) of motor mounting seat (7) and fixed by screws (16). Canvas filter bag (5) is inserted into tank (1), and the upper edge of said tank (1) is completely covered by the inverted U-shaped circular slot (61) of rubber circular frame (6) at the upper edge of canvas filter bag (5). The above mentioned upper cover (13) of motor mounting seat (7) is then placed on the upper edge of said tank (1) and the circular slot (711) of the base at the outer diameter (71) of motor mounting seat (7) is fitted tightly with the circular frame (6) of canvas filter bag (5) engaged at the upper edge of said tank (1). Motor mounting seat (7) is finally fixed by clamps (3) at the upper edge of the tank's (1) face to the protruded lugs (713) at the upper face at the outer diameter (71) of motor mounting seat (7) to achieve tight fixation. When the whole vacuum cleaner is set up, the whole set is lifted up by the two handles (50) on the side of said tank (1) by manpower and placed in the circular recess (22) on the supporting surface (21) of said dolly (2). When the vacuum cleaner is used to suck up liquid and the liquid level has reached a predetermined height, float (9) of motor fixing seat (7) will rise up and block the sucking orifice (72) of the motor (shown in FIG. 1) and pull the string (10) to lower the spring contact leaf (111) of micro switch (11) so as to stop the rotation of the motor immediately, and when the motor is cut off from the power supply, the buzzer (12) will be connected to give out a "buzz" sound.

I claim:

1. A multi-purpose vacuum cleaner for cleaning both liquid and solid matter comprising:

a tank open at its top and having a motor mounting seat covering said tank so as to close said top opening, said motor mounting seat having a circular orifice therethrough and an electric vacuum motor mounted on an upper surface so as to draw air through said orifice to create a vacuum in said tank;

a filter cage within said tank fixed to the lower surface of said motor mounting seat around said orifice;

a switch fixed to said motor mounting seat having a first terminal connected to a source of electric power and a second terminal connected to said electric vacuum motor, said switch further including a spring contact leaf normally connecting said first terminal to said second terminal;

a spherical float positioned in said filter cage having one end of a string connected thereto, said string passing through a fixed point on said filter cage and having a second end connected to said switch spring contact leaf so as to actuate said spring contact leaf when said float rises to a predetermined level within said filter cage;

such that liquid filling said tank to said predetermined level will cause said spherical float to rise and actuate said switch spring contact leaf, thereby disconnecting power from said electric vacuum motor, said predetermined level being set such that said spherical float will obstruct said circular orifice and prevent flow of liquid to said vacuum motor.

2. A multi-purpose vacuum cleaner as recited in claim 1, wherein said switch includes a third contact connected to an electric alarm device, and auctation of said switch spring contact leaf by said float will switch said spring contact leaf from said second contact to said third contact to energize said alarm device, indicating that said predetermined liquid level has been reached.

* * * * *